US008978294B2

(12) United States Patent
Adams

(10) Patent No.: US 8,978,294 B2
(45) Date of Patent: Mar. 17, 2015

(54) STACKABLE HOLDER OR PLANTER FOR POTTED PLANTS

(71) Applicant: William E. Adams, Portersville, PA (US)

(72) Inventor: William E. Adams, Portersville, PA (US)

(73) Assignee: Adams Mfg. Corp., Portersville, PA (US)

( * ) Notice: Subject to any disclaimer, the term of this patent is extended or adjusted under 35 U.S.C. 154(b) by 0 days.

(21) Appl. No.: 14/090,632

(22) Filed: Nov. 26, 2013

(65) Prior Publication Data

US 2014/0083003 A1 Mar. 27, 2014

Related U.S. Application Data

(62) Division of application No. 12/940,256, filed on Nov. 5, 2010, now abandoned.

(51) Int. Cl.

| | |
|---|---|
| ***A01G 9/02*** | (2006.01) |
| ***A47G 7/02*** | (2006.01) |
| ***A47G 7/04*** | (2006.01) |

(52) U.S. Cl.

CPC . *A47G 7/02* (2013.01); *A47G 7/041* (2013.01)
USPC ..... 47/39

(58) Field of Classification Search

CPC ..... A01G 9/02; A01G 9/022; A01G 9/027; A47G 7/02; A47G 7/041
USPC ..... 47/39
See application file for complete search history.

(56) References Cited

U.S. PATENT DOCUMENTS

| | | | | |
|---|---|---|---|---|
| 2,409,925 | A | 10/1946 | Bloom | |
| 3,342,147 | A * | 9/1967 | Shettles | 108/64 |
| 5,182,996 | A * | 2/1993 | Gutgsell | 108/64 |
| D346,704 | S | 5/1994 | Grosfillex | |
| D347,527 | S | 6/1994 | Breen et al. | |
| D359,406 | S | 6/1995 | Crawford et al. | |
| 5,438,937 | A * | 8/1995 | Ball et al. | 108/64 |
| D376,281 | S | 12/1996 | Robertson | |
| 5,592,884 | A | 1/1997 | Glick et al. | |
| 6,138,863 | A | 10/2000 | Aiken | |
| 6,517,035 | B1 * | 2/2003 | Sellers | 248/146 |
| 6,783,023 | B1 | 8/2004 | Fan | |
| 6,907,693 | B1 * | 6/2005 | Bemben | 47/65 |
| D555,401 | S | 11/2007 | Adams | |
| D555,942 | S | 11/2007 | Adams | |
| D655,221 | S * | 3/2012 | Adams | D11/155 |
| 2005/0039391 | A1 | 2/2005 | Morse | |
| 2008/0083162 | A1 * | 4/2008 | Vandyken | 47/39 |
| 2011/0232184 | A1 * | 9/2011 | Fagan | 47/66.6 |

* cited by examiner

*Primary Examiner* — Monica Williams
(74) *Attorney, Agent, or Firm* — Buchanan Ingersoll & Rooney PC

(57) ABSTRACT

A stackable holder for a potted plant has a top having a central opening and a plurality of legs extending from the top. A plurality of flexible flaps may extend inward from the central opening, and be frangibly joined to each other along a length of the flap. The stackable holder has a plurality of connectors attached to the top and/or the legs, which may connect multiple stackable holders side-by-side in a row. The stackable holder is configured so that it may be stacked upon a second stackable holder, allowing the stackable holders to be tightly packed for storage or shipment. The stackable holder may have a planter body having a base and at least one sidewall extending from the base to form a cavity. The planter body may be attached to the stackable holder or may be removable. The planter body may have a lid.

6 Claims, 7 Drawing Sheets

STACKABLE HOLDER OR PLANTER FOR POTTED PLANTS

FIELD OF INVENTION

The invention relates to planters for flowers and other plants.

BACKGROUND OF THE INVENTION

There are a variety of planters available in the marketplace for flowers and other plants. All planters have a body which defines a cavity in which potting soil is held. Most planters in the market are molded plastic. Others are made from materials such as fiber, porcelain, clay, foam, and metal.

Retailers have limited space in which to display products being offered for sale. Consequently, there is a preference for products that can be stacked or nested thereby providing more units in a given volume. The unit cost to ship and store products which are nested together is significantly less than the storage and shipping costs of products which cannot be nested. It is preferable that the planters can be tightly packed and condensed for transport.

Some potted plants may grow to be tall. Multiple tall potted plants are often displayed in a row for aesthetic purposes. Such plants may have a center of gravity that is high off the ground due to the height of the plant. Furthermore, such tall plants have more surface area against which wind may blow if such plants are displayed outdoors. Consequently, these plants may tip over, especially in moderate to high winds. A new holder for potted plants is needed which increases the stability of plants that grow to be tall. The new potted plant holder should preferably be simple and inexpensive, but sturdier than a regular plant pot and capable of being anchored to other holders for increased stability among all potted plant holders when tall potted plants are displayed in a row.

SUMMARY OF THE INVENTION

I provide a stackable holder for plants which may receive or have a pot which can be filled with potting soil in which a flower or other plant may be grown. The holder has a top with a central opening and legs that extend from the top. In some embodiments a pot is placed in the opening in the top. The pot may be removable from the top or integrally formed with the top. The legs preferably have a curved cross-section along their length so that the holders can be stacked and nested together.

For those embodiments which are sold without a pot or sold with a removable pot, I prefer to provide flexible flaps on the perimeter of the opening that extend inwardly. These flaps enable the holder to receive a range of pot sizes. Adjacent flaps may be connected together along all or a portion of their length such that there is a joint between them which may be easily cut or broken to enable a larger pot to fit through the opening.

In those embodiments having a pot, which embodiments may be called planters, the pot has a base and at least one sidewall extending from the base to the top of the holder to define a cavity. The sidewalls and the legs are configured such that the pot can be positioned within the pot of a second planter. The base and the sidewalls of the pot extend into the cavity of the pot in the second planter, and the legs of the planter extend over the legs of the second planter.

The planter body may be made of plastic. A lip may extend from the interconnected sidewalls. The sidewalls may be tapered. The base, sidewalls, and legs may be an integrally formed unit.

I prefer to provide a plurality of connectors attached to the top, which are positioned and configured to enable two or more holders to be connected together side by side. The legs may have feet which are sized and configured to connect to and mate with feet of the second planter. The stackable planter may include a lid sized and configured to cover the cavity. The lid may be connected to the top of a sidewall.

Other objects and advantages of the present invention will become apparent from a description of certain present preferred embodiments thereof shown in the drawings.

DESCRIPTION OF THE PREFERRED EMBODIMENTS

Figure 1:
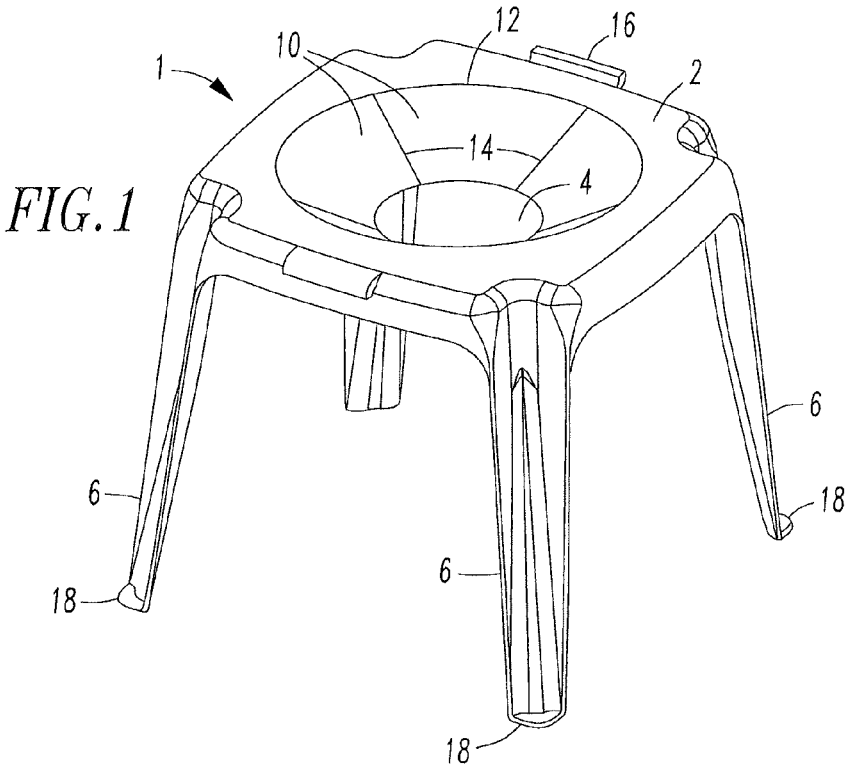
FIG. 1 is a perspective view of a present preferred embodiment of my stackable holder.
Figure 2:
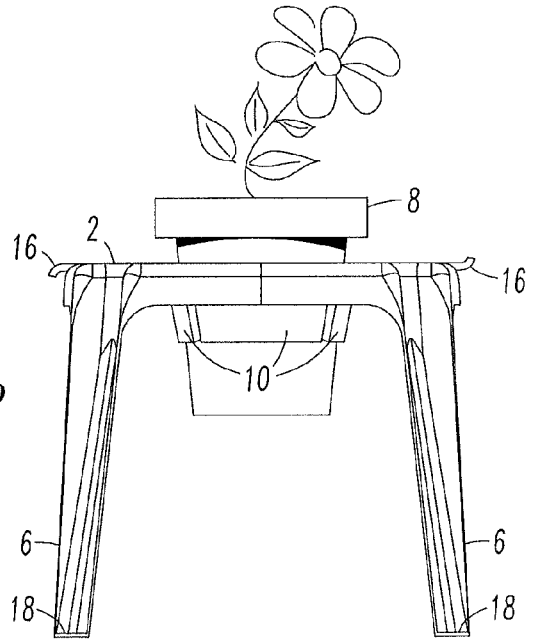
FIG. 2 is a side view of a stackable holder of the type shown in FIG. 1 holding a pot.

A present preferred embodiment of my stackable holder 1 is shown in FIGS. 1 through 4. I provide a top 2 having a central opening 4 and a plurality of legs 6. A plurality of flexible flaps 10 extend inward from the perimeter 12 of the central opening 4. Adjacent flaps 10 may be joined together along all or a portion of their length such that there is a joint 14 between them. When a pot 8 is at least partially positioned within the central opening 4 the flaps 10 bend downward and hold the pot in place, as may be appreciated from FIG. 2. Preferably, the joints 14 may be thin plastic or frangible so they can be easily cut or broken, allowing a larger pot 8 to be at least partially positioned within the central opening 4.

I prefer to provide a plurality of connectors 16 which are attached to the top 2. The connectors 16 are positioned and configured to enable two or more stackable holders 1 to be connected together side by side. I also contemplate providing feet 18 on the ends of the legs 6. The feet 18 may be sized and configured to interlock with other similar feet 18. Such interlocking may be accomplished for instance by a tongue and groove joint, a lap joint, or other interlocking mechanism. The connectors 16 and the interlocking feet 18 allow two or more stackable holders 1 to be positioned next to each other and connected to each other for increased stability.

Figure 4:
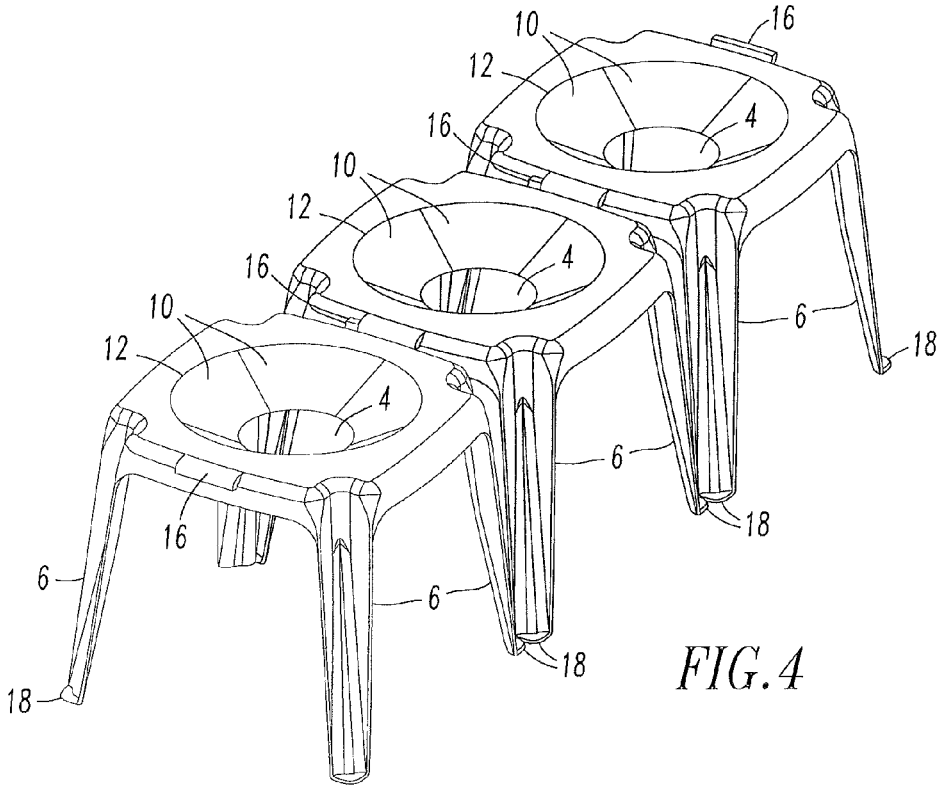
FIG. 4 is a perspective view of three stackable holders of the type shown in FIG. 1 interconnected for increased stability.

Multiple stackable holders 1 may be arranged in an interlocking row as may be appreciated from FIG. 4. A connector 16 on the first stackable holder may mate with and connect to a connector 16 on the second stackable holder. A connector 16 on the second stackable holder may mate with and connect to a connector 16 on the third stackable holder. Additionally or alternatively, the feet 18 of the first stackable holder may mate with and connect to the feet 18 of the second stackable holder, and the feet 18 of the second stackable holder may mate with and connect to the feet 18 of the third stackable holder. Interlocking the stackable holders in this fashion increases the stability of the stackable holders. Consequently, tall potted plants may be placed in such stackable holders and when connected together via the connectors 16 and/or the interlocking feet 18 there is a greatly decreased chance of a plant being blown over.

Figure 3:
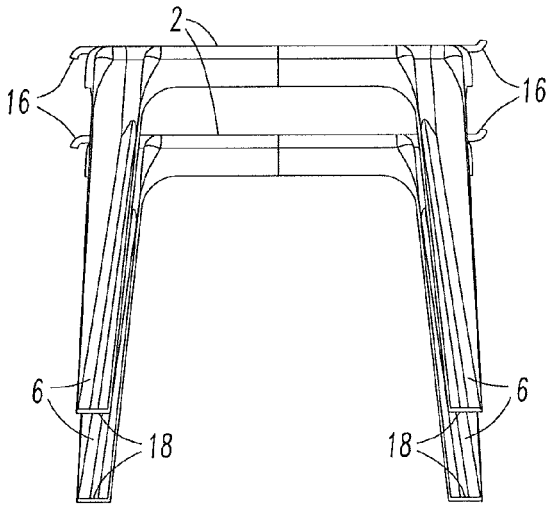
FIG. 3 is a side view of two stackable holders of the type shown in FIG. 1 stacked for storage and shipment.

The stackable holder 1 is sized and configured so that multiple stackable holders may be stacked and nested as may be appreciated from FIG. 3. When so stacked and nested, the legs 6 of the first stackable holder 1 fit over the legs of the second stackable holder. I prefer to provide legs 6 with a curved cross section so that the legs 6 of the first stackable holder 1 may nest within the legs of the second stackable holder. Consequently several of these stackable holders when stacked and nested together form a very dense stack for storage and shipment.

Figure 5:
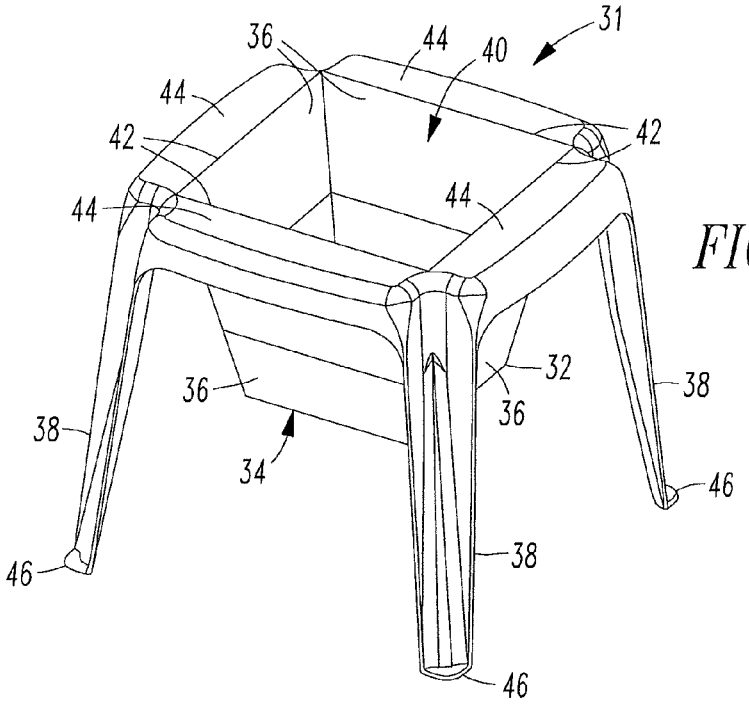
FIG. 5 is a perspective view of a second preferred embodiment of my stackable holder which may be called a stackable planter.
Figure 6:
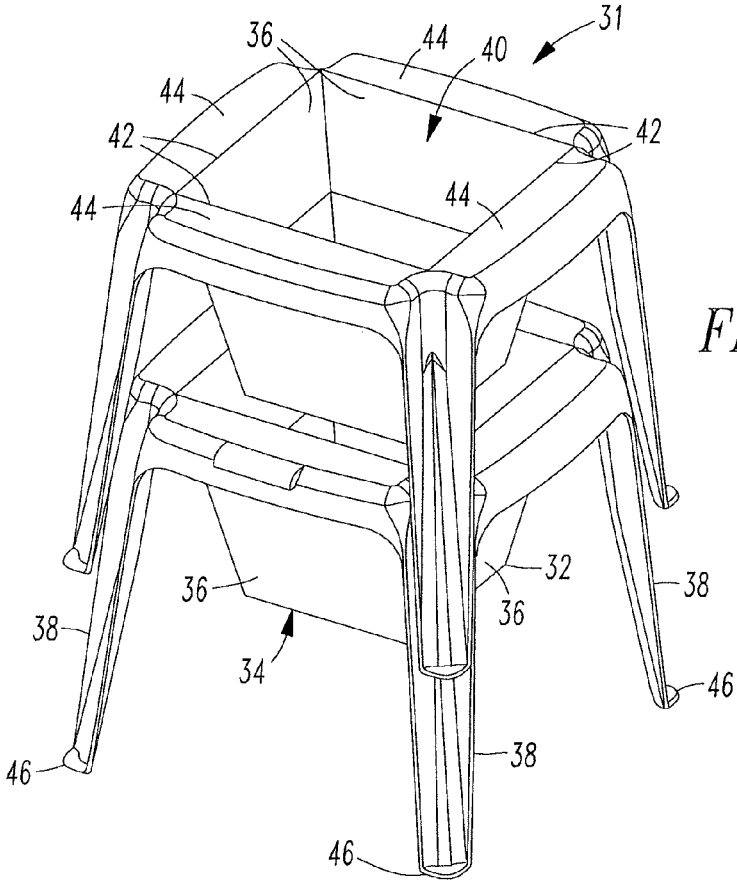
FIG. 6 is a side view of two stackable planters of the type shown in FIG. 5 being stacked for storage and shipment.

A second preferred embodiment of my stackable planter 31 is shown in FIGS. 5 and 6. I provide a planter body 32 having a base 34, at least one sidewall 36, and a plurality of legs 38. The sidewalls 36 extend from the base 34 to define a cavity 40 in which potting soil may be placed. The sidewalls 36 are preferably sloped. Each sidewall 36 has a top 42. The legs 38 are attached to the tops 42 of the sidewalls 36. Each sidewall 36 preferably has a lip 44 extending outward from the top 42 of the sidewall 36.

I prefer to provide a generally rectangular base 34, but of course other shapes for the base 34 are possible. Similarly, I prefer to provide four legs 38 for my stackable planter 31, but I also contemplate any other number or configuration of legs 38.

Figure 7:
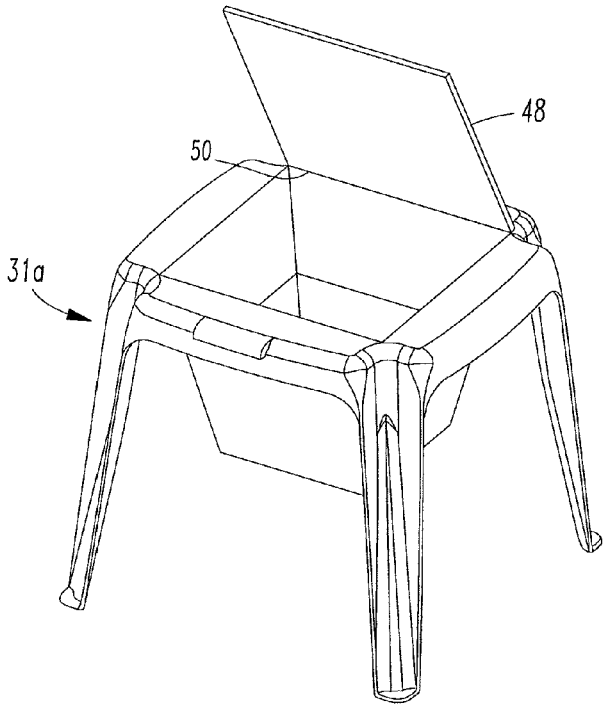
FIG. 7 is a perspective view of a stackable planter of the type shown in FIG. 5 with a lid attached.
Figure 8:
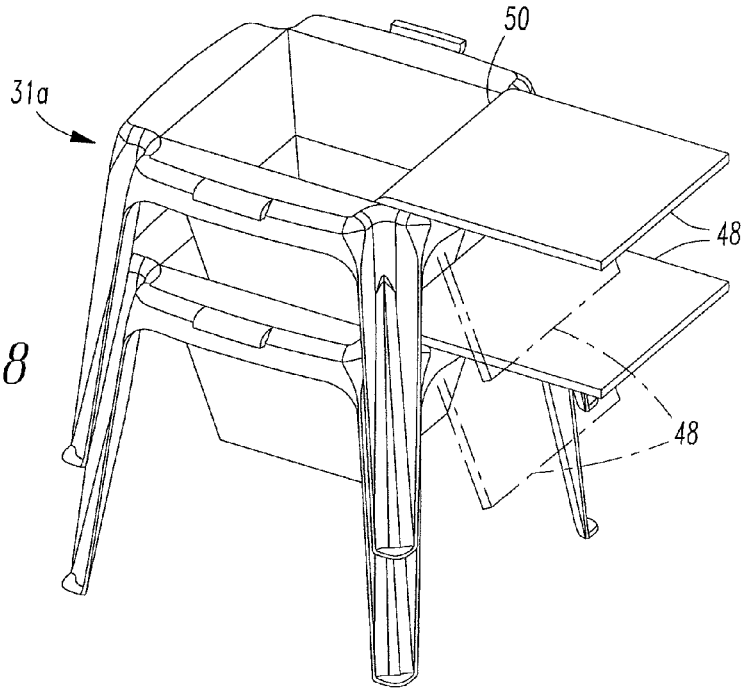
FIG. 8 is a side view of two stackable planters of the type shown in FIG. 7 stacked for storage and shipment.

I may provide a lid 48 with my stackable planter 31*a* as shown in FIGS. 7 and 8. The lid 48 is sized and configured to cover the cavity 40. I prefer to provide the lid 48 as a separate component of my stackable planter 31. However, the lid 48 may be attached to the top 42 of a sidewall 36, as may be appreciated from FIGS. 7 and 8. The lid 48 may be connected to the top 42 of a sidewall 36 by for example a hinge 50.

Figure 9:
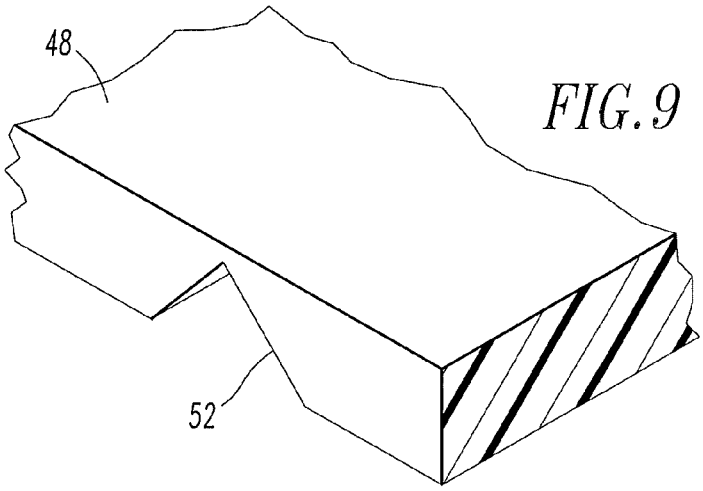
FIG. 9 is an enlarged fragmentary view of a lid having a groove in the middle to provide a hinge or fold line.
Figure 10:
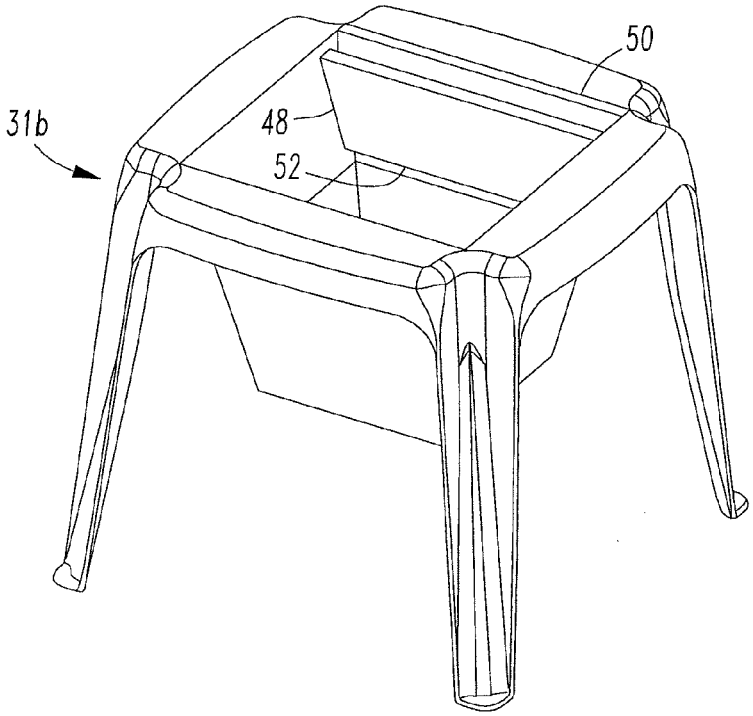
FIG. 10 is a perspective view of a stackable planter of the type shown in FIGS. 7 and 8 with the lid having a groove attached and folded for storage or shipment.

Although I prefer the lid 48 to be rigid, I contemplate that the lid 48 may be at least partially able to fold or bend. The embodiment 31*b* shown in FIGS. 10 and 11 has a lid 48 that folds. Such folding or bending may be possible by for example the presence of a groove 52 running through the lid 48, as may be appreciated from FIG. 9. The groove 52 may be parallel to the top 42 of the sidewall 36 to which the lid 48 may be attached. This may allow the lid 48 to fold or bend at least partially over itself to be placed inside the cavity 40 when not in use.

Figure 11:
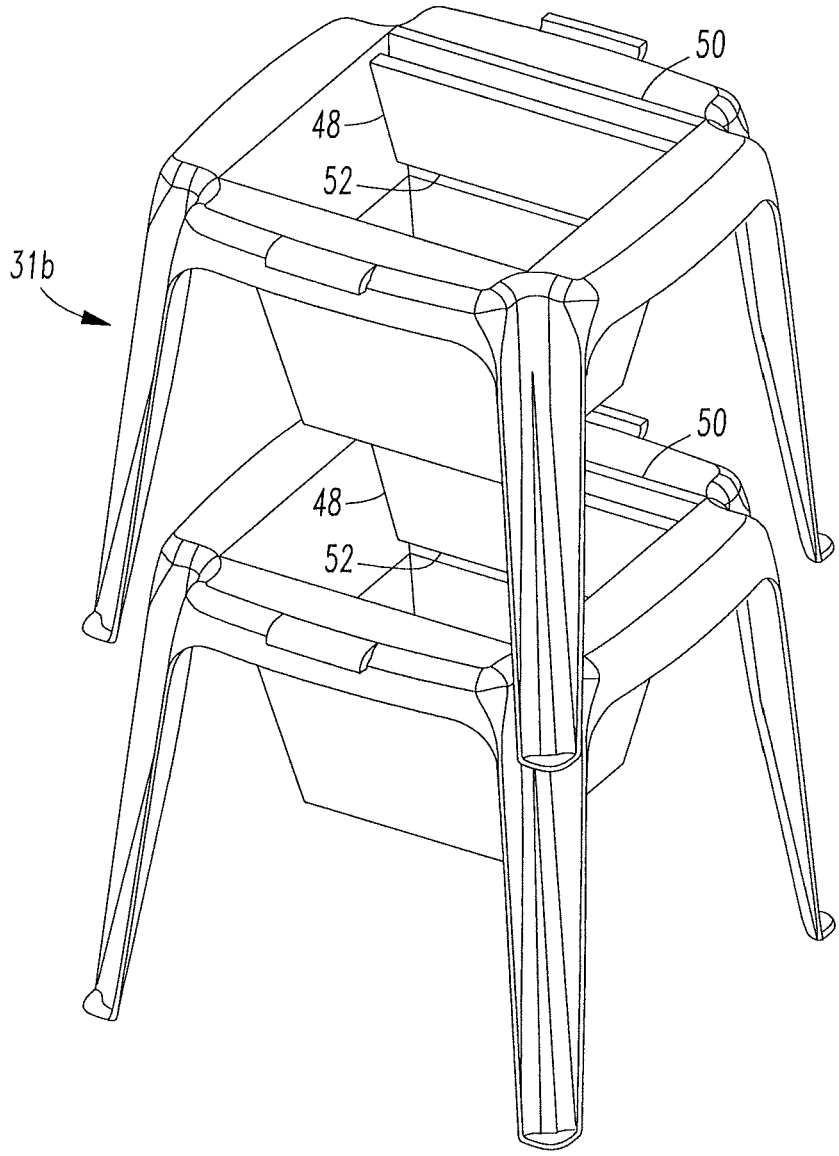
FIG. 11 is a side view of two stackable planters of the type shown in FIG. 10 with their lids folded and being stacked for storage or shipment.

The stackable planter 31, 31*a* and 31*b*, is sized and configured so that multiple stackable planters may be stacked and nested as shown in FIGS. 6, 8 and 11. When so stacked and nested, the planter body 32 of the first stackable planter 31 fits within the cavity of the second stackable planter, and the legs 38 of the first stackable planter 31 fit over the legs of the stackable second planter as shown in FIG. 6. I prefer to provide legs 38 with a curved cross section so that the legs 38 of the first stackable planter 31 may nest within the legs of the second stackable planter. Consequently, several of these stackable planters when stacked and nested together form a very dense stack for storage and shipment.

Stacking and nesting my stackable planter 31 is possible even when the planter 31 has the lid 48 attached to the top 42 of a sidewall 36, as may be appreciated from FIG. 8. The lid 48 preferably may extend away from the cavity 40 of the one stackable planter 31 and extend between the legs of any stackable planter stacked above the one stackable planter 31. Alternatively, if the lid 48 may flex or bend at least partially over itself, it may then be able to be stored within the cavity 40 of the stackable planter 31 as may be appreciated from FIG. 11.

Figure 12:
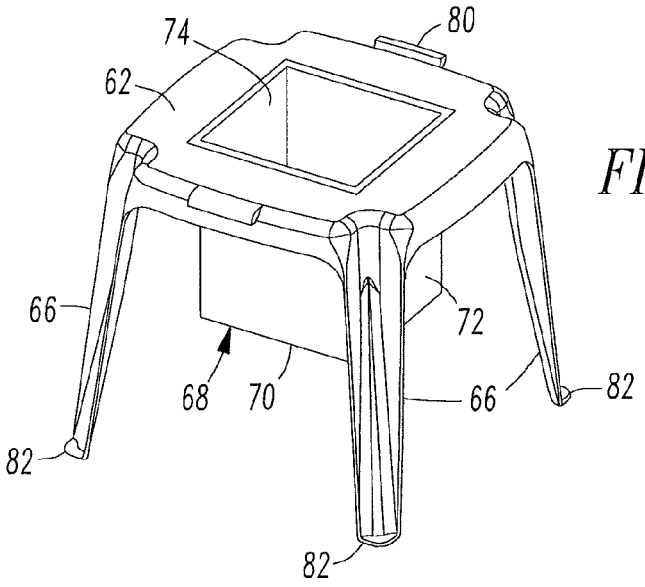
FIG. 12 is a perspective view of a third present preferred embodiment of my stackable planter having a removable body.
Figure 13:
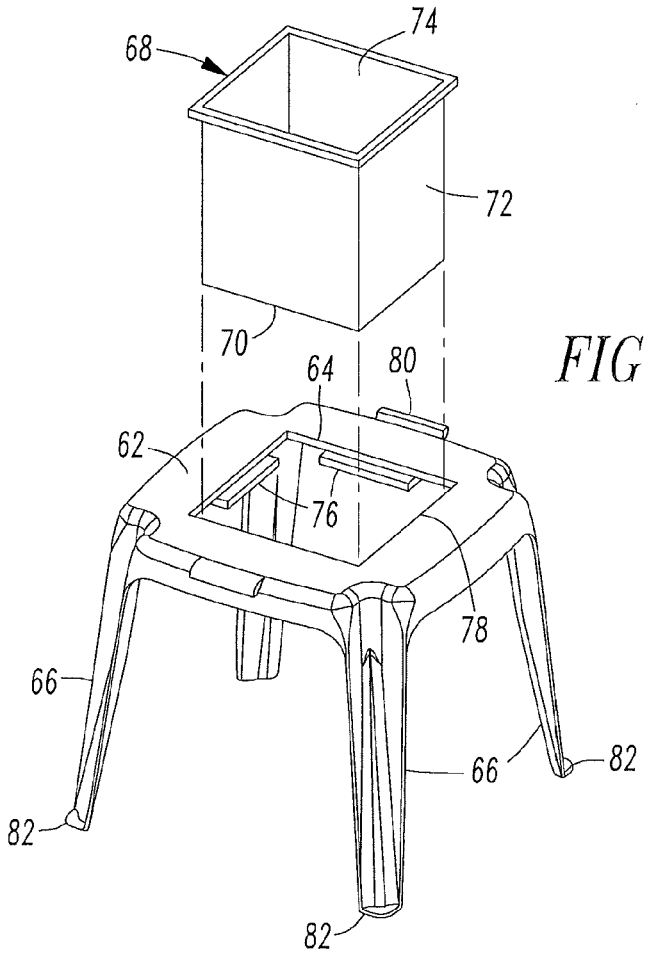
FIG. 13 is an exploded view of a stackable planter of the type shown in FIG. 12.

A third embodiment of my stackable planter 61 may be appreciated from FIGS. 12 and 13. I provide a top 62 having a central opening 64 and a plurality of legs 66. A plurality of flexible or rigid flaps 76 may extend inward from the perimeter 78 of the central opening 64. The central opening 64 is sized and configured to receive a planter body 68. The planter body 68 has a base 70 and at least one sidewall 72 extending from the base 70 to define a cavity 74 in which potting soil may be placed.

This embodiment of my stackable planter 61 allows the planter body 68 to be removed from the top 62, as can be appreciated from FIG. 13. Removing the planter body 68 in this fashion allows plants to be easily swapped or repositioned, or to be easily removed from adverse weather conditions, without the need to move the entire stackable planter 61.

I prefer to provide a plurality of connectors 80 which are attached to the top 62. The connectors 80 are positioned and configured to enable two or more stackable planters 61 to be connected together side by side. I also contemplate providing feet 82 on the ends of the legs 66 away from the top 62. The feet 82 may be sized and configured to interlock with other similar feet 82. Such interlocking may be accomplished for instance by a tongue and groove joint, a lap joint, or other interlocking mechanism. The connectors 80 and the interlocking feet 82 allow two or more stackable planters 61 to be positioned next to each other and connected to each other with increased stability.

The stackable planter 61 is sized and configured so that multiple stackable planters may be stacked and nested. When so stacked and nested, the legs 66 of the first stackable planter 61 fit over the legs of the second stackable planter. I prefer to provide legs 66 with a curved cross section so that the legs 66 of the first stackable planter 61 may nest within the legs of the second holder. Consequently several of these holders when stacked and nested together form a very dense stack for storage and shipment.

The planter bodies, legs, and lids of all present preferred embodiments are preferably made from injection molded plastics such as polycarbonate or polyvinylchloride. For ease of molding I prefer that the embodiments with sidewalls have the sidewalls be tapered, as can be seen in FIGS. 5-9 and 11-14, rather than be perpendicular to the base.

The connectors 16 and 80 are shown in the drawings a curved tabs with the curvature reversed on the opposite sides of the holder or planter so that the connectors can interlock. It should be understood that other types of connectors could be used such a plug and socket or tongue and groove. Whatever connectors are used, they should be of a size and shape such that the connectors can be integrally molded with the holder or planter. Preferably the holder or planter is made from a polycarbonate or polyvinyl chloride material. Other suitable plastics or composite materials could be used.

Although I have described and illustrated certain present preferred embodiments of my stackable holders or planters it should be distinctly understood that the invention is not limited to but may be variously embodied within the scope of the following claims.

I claim:

1. A stackable planter comprising:

a planter body comprised of a base and at least one sidewall extending from the base to define a cavity;

a top having a central opening sized to receive the planter body;

a plurality of legs extending from the top; and a plurality of connectors each connector attached to the top or to one of the legs;

wherein the legs and the planter body are configured so that multiple stackable planters are stackable, each stackable planter having the planter body at least partially positioned within the central opening, the legs from one stackable planter able to nest within the legs of a second stackable planter on which the one stackable planter is stacked, and the planter body of one stackable holder able to fit within the cavity of the second stackable planter on which the one stackable planter is stacked; and wherein the connectors are positioned so that stackable planters may be connected together side by side.

2. The stackable planter of claim 1 wherein the planter body and the legs are plastic.

3. The stackable planter of claim 1 wherein the sidewalls are tapered.

4. The stackable planter of claim 1 also comprising a lid sized and configured to cover the cavity.

5. The stackable planter of claim 4 wherein the lid is connected to the top of a sidewall.

6. The stackable planter of claim 4 wherein the lid is at least partially foldable or bendable.

* * * * *